US006094473A

United States Patent [19]

Yu

[11] Patent Number: 6,094,473

[45] Date of Patent: Jul. 25, 2000

[54] DIGITAL AUTOMATIC X-RAY EXPOSURE CONTROL SYSTEM

[75] Inventor: Phillip H. Yu, Wickliffe, Ohio

[73] Assignee: Picker International, Inc., Highland Heights, Ohio

[21] Appl. No.: 09/044,541

[22] Filed: Mar. 19, 1998

[51] Int. Cl.[7] ..... H05G 1/44

[52] U.S. Cl. ..... 378/108; 378/97

[58] Field of Search ..... 378/97, 108

[56] References Cited

U.S. PATENT DOCUMENTS

| | | | |
|---|---|---|---|
| 4,019,189 | 4/1977 | Kitai et al. . | |
| 4,154,516 | 5/1979 | Wagensonner et al. . | |
| 4,282,432 | 8/1981 | Franke . | |
| 4,578,767 | 3/1986 | Shapiro . | |
| 4,668,069 | 5/1987 | Hasegawa . | |
| 4,699,502 | 10/1987 | Araki et al. . | |
| 4,831,642 | 5/1989 | Chattin . | |
| 4,935,950 | 6/1990 | Ranallo et al. . | |
| 5,008,564 | 4/1991 | Hartwig | 331/1 R |
| 5,179,582 | 1/1993 | Keller et al. . | |
| 5,333,168 | 7/1994 | Fernandes et al. | 378/108 |
| 5,617,462 | 4/1997 | Spratt . | |

*Primary Examiner*—Craig E. Church
*Attorney, Agent, or Firm*—Fay, Sharpe, Fagan, Minnich & McKee, LLP

[57] ABSTRACT

A digital automatic X-ray exposure control system (22, 24, 26) includes a digital frequency modulated output signal circuit (40) generating a digital frequency modulated output signal (42) having a pulse rate that is frequency modulated in proportion to the level of an X-ray beam received at an ion chamber of an X-ray imaging apparatus. A digital input circuit (22) connected to the output circuit via a digital communication interface cable (26) receives the digital output signal and generates an exposure termination signal (80) for use by the X-ray imaging apparatus to interrupt the generation of the X-ray beam at a precise exposure level. The digital input circuit includes a digital counter circuit (70) for counting pulses in the output signal as a pulse count value that is compared against an exposure length parameter value (74) for generating a count match signal (76) based on a correspondence therebetween. A processor circuit (72) receives the count match signal and generates the exposure termination signal for extinguishing the X-ray beam. An X-ray film sensitivity circuit (64) and a digital short-time exposure compensation circuit (62) is included in the subject digital automatic exposure control system. The X-ray film sensitivity circuit includes a programmable clock divider circuit (96) for scaling the digital output signal in accordance with the screen sensitivity of the X-ray film. The digital short-time compensation circuit (62) includes a programmable frequency multiplier circuit (86) for multiplying the digital output signal by a clock multiplier scaling factor parameter during a brief programmable timing period.

21 Claims, 4 Drawing Sheets

DIGITAL AUTOMATIC X-RAY EXPOSURE CONTROL SYSTEM

BACKGROUND OF THE INVENTION

The present invention relates to the art of medical diagnostic imaging. The invention finds particular application in conjunction with X-ray imaging apparatus and will be described with particular reference thereto. The invention will also find application in other imaging systems where control of exposure times are important, such as, for example, nuclear or gamma camera type systems, or the like.

The typical X-ray imaging apparatus includes an X-ray generator that radiates an X-ray beam in a direction towards a patient disposed between the X-ray generator and an X-ray film screen. The film is usually contained in cassette that is disposed adjacent an ion chamber. The X-ray beam is developed at the X-ray generator by applying a high voltage between an X-ray tube anode and an X-ray tube cathode, sometimes referred to as an electron emissive filament. When a positive large voltage is applied to the X-ray tube anode, the cathode filament is heated causing electrons to be scattered randomly therefrom. An electron beam focusing cup associated with the cathode concentrates the electrons from the cathode to impinge at a focal spot on the anode to, in turn, produce an X-ray beam emitting from the focal spot.

It is known that the energy or penetrating power of the X-ray beam generated by the X-ray tube is proportional to the kilovoltage kV that is applied between the anode and cathode of the X-ray tube. Also, the quantity or intensity of the X-ray photons is proportional to the electron beam current mA that flows between the anode and the cathode of the X-ray tube. Both the X-ray tube kV and mA are exposure control factors that are selected by an imaging technician before commencing an exposure.

One other parameter that is selectable by the imaging technician is the exposure time of the X-ray beam on the patient. Precise exposure control is critical to produce good, clear X-ray images. In addition, since over-exposure of patients to X-ray beams could be harmful to the patient, precise exposure control is critical.

In the past, analog automatic exposure control systems have been used in X-ray imaging apparatus to extinguish the X-ray beam based on a comparison between an analog feedback signal and various control and other parameters selected by an imaging technician. Analog automatic X-ray exposure control systems, however, have met with limited success.

One problem with conventional analog automatic exposure control systems has been their limited dynamic range, especially when interfaced with standard type ion chambers typically found in most X-ray imaging devices. The typical analog automatic exposure control system includes an integrator circuit disposed at the ion chamber for developing an X-ray power integration signal. The signal dynamic range, however, is limited by the power supply of the integrator, typically plus/minus 15 volts. Accordingly, it becomes very difficult to accommodate a wide range of X-ray film/screen speed combinations due mainly to signal saturation in the integrator.

Another problem with conventional analog automatic exposure control systems is their poor signal-to-noise ratio at low signal levels. This, in turn, causes a significant film density variation for high kV imaging procedures in normal use. The poor signal to noise ratio of the conventional analog systems is due mainly to comparator noise at the X-ray generator and, in addition, to noise caused by analog transmission of the integrator signal typically long signal cables extending between the ion chamber and the X-ray generator.

Lastly, in connection with the shortcomings of the conventional analog automatic exposure control systems, another problem is the difficulty in adjusting those systems to provide for a wide range of short exposure time compensation. In that regard, precise pre-termination techniques require an enhanced level of adjustability to accommodate the anticipated range of ion chamber response time delays and generator exposure termination delays that one would expect to face when using an X-ray imaging apparatus on a wide range of body parts with multiple patients. Conventional analog short exposure time compensation circuits include a differentiator with a potentiometer and a summing amplifier to compensate the X-ray imaging apparatus for short exposure times. These circuit typically provided only a modest level of adjustability. Also, access to the potentiometer and manual manipulation thereof to adjust the X-ray pre-termination trip point was time consuming and inconvenient.

It would, therefore, be desirable to provide a digital automatic X-ray exposure control circuit that is relatively immune to signal noise and is operable over a wide dynamic range to accommodate many X-ray film and film speed combinations.

It would further be desirable to provide such a digital exposure control system in order to improve the signal-to-noise ratio of the imaging apparatus at low signal levels. This would allow for longer signal cable lengths between the X-ray generator and the ion chamber.

Still further, it would be desirable to provide a digital exposure control system that can accommodate a wide range of ion chamber response time delays and X-ray generator exposure termination delays. It would be desirable to provide for digital pre-termination trip points to effect short time compensation.

SUMMARY OF THE INVENTION

In accordance with the present invention, a new and improved digital automatic X-ray exposure control system is provided for use with an X-ray imaging apparatus of the type generating an X-ray beam from an X-ray generator and receiving the X-ray beam on an X-ray film screen at an ion chamber. A digital signal output circuit is disposed at the ion chamber of the X-ray imaging apparatus. The digital signal output circuit is adapted to generate a digital output signal in proportion to the level of the X-ray beam received at the ion chamber. A digital signal input circuit is connected to the X-ray generator of the X-ray imaging apparatus. The digital signal input circuit is adapted to receive the digital output signal from the digital signal output circuit and generate an exposure termination signal for use by the X-ray imaging apparatus to interrupt the generation of the X-ray beam. The digital signal input circuit at the X-ray generator is connected to the digital signal output circuit at the ion chamber via an elongate cable adapted to transmit digital signals.

In accordance with a more limited aspect of the present invention, the digital signal output circuit is a digital frequency modulated output signal circuit adapted to generate a digital frequency modulated output signal having a pulse rate that is frequency modulated in proportion to the level of the X-ray beam received at the ion chamber of the X-ray imaging apparatus.

In accordance with another aspect of the present invention, the digital frequency modulated output signal circuit includes an X-ray beam sensor, a current-to-voltage converter circuit, and a voltage controlled oscillator for generating the digital frequency modulated output signal. The X-ray beam sensor receives the X-ray beam at the ion chamber and generates an electric current output signal having a current level in proportion to the intensity level of the X-ray beam. The current-to-voltage convertor circuit converts the electric current output signal from the X-ray beam sensor into an electric voltage output signal having a voltage level proportional to the current level from the X-ray beam sensor. Lastly, the voltage controlled oscillator circuit generates the digital frequency modulated output signal based on the voltage level of the electric voltage output signal from the current-to-voltage convertor circuit.

In accordance with yet another aspect of the present invention, the digital signal input circuit at the X-ray generator includes a digital counter circuit for counting pulses in the digital frequency modulated output signal as a pulse count value. The digital signal input circuit generates a count match signal based on a comparison between the pulse count value and an exposure length parameter value stored in the digital signal input circuit. A processor circuit included in the digital signal input circuit generates the exposure termination signal in response to receiving the count match signal from the digital counter circuit. The exposure termination signal is used by the X-ray imaging apparatus to interrupt the generation of the X-ray beam.

In accordance with yet a more limited aspect of the present invention, an X-ray film screen sensitivity compensation circuit is included for modifying the digital frequency modulated output signal generated by the digital signal output circuit to compensate the automatic exposure control system for variations in film speed of the X-ray film screen used by the imaging apparatus at the ion chamber. The X-ray film screen sensitivity compensation circuit is a programmable clock divider circuit for scaling the digital frequency modulated output signal generated by the digital signal output circuit by dividing the digital output signal by a clock divider parameter value.

In accordance with yet another more limited aspect of the present invention, a digital short time compensation circuit is provided for modifying the digital frequency modulated output signal generated by the digital signal output circuit to compensate the automatic exposure control system for variations in ion chamber response delay time and X-ray generator exposure termination delay time. The digital short time compensation circuit includes a programmable pulse generator circuit and a programmable frequency multiplier circuit. The pulse generator circuit generates a timing pulse in response to an actual length of exposure signal generated by the X-ray imaging apparatus. The timing pulse has a selectable duration. In that regard, the timing pulse is sustained for a timing period based on a response time calibration parameter value stored in the short time compensation circuit. The programmable frequency multiplier circuit selectively scales the digital frequency modulated output signal generated by the digital signal output circuit by multiplying the digital signal during the timing period by a clock multiplier parameter value stored in the digital short time compensation circuit. Outside of the timing period, the digital frequency modulated output signal is not multiplied by the clock multiplier parameter value.

One advantage of the present invention is that a wide range of X-ray film and screen speed combinations can be accommodated in the X-ray imaging apparatus without the need for manual adjustment of any analog gain setting devices.

Another advantage of the present invention is a high level of noise immunity between the digital signal input and output circuits for a more accurate control over X-ray exposure.

Yet another advantage of the present invention is an optimization of sensitivity to X-ray film speed provided by the digital screen sensitivity adjustment circuit which uses a software clock divider parameter value to scale the digital X-ray exposure signal received from the digital signal output circuit.

Still yet another advantage of the present invention is that a wide range of automatic short exposure time compensation is easily accomplished using a digital short time compensation circuit by merely adjusting a pair of software parameter values.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

DETAILED DESCRIPTION OF THE PREFERRED EMBODIMENTS

Figure 1:
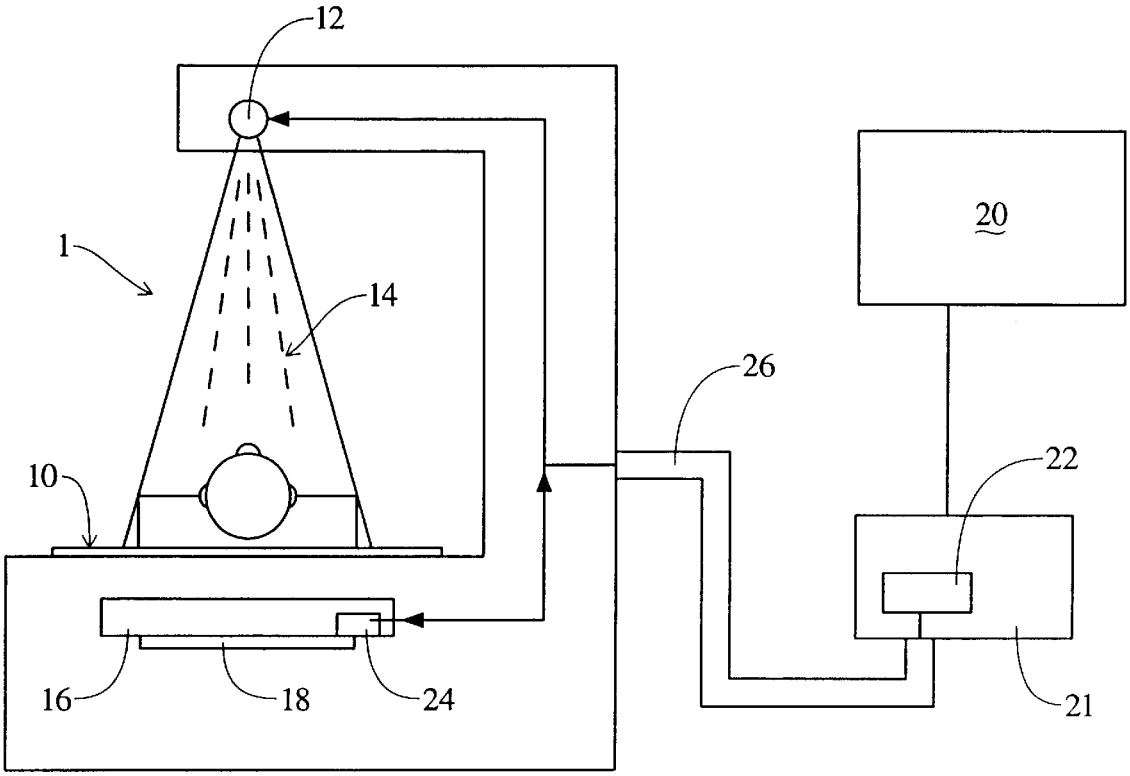
FIG. 1 is a diagrammatic illustration of a digital automatic exposure control system integrated with an X-ray imaging apparatus in accordance with the present invention.

With reference first to FIG. 1, an X-ray imaging apparatus 1 is shown including a patient is received on a patient support 10. An overhead X-ray tube 12 generates an X-ray beam 14 in a direction towards the patient on the support. An ion chamber 16 of the X-ray imaging apparatus 1 is disposed between a sheet of X-ray development film 18 and the patient support 10. In that way, the X-ray beam 14 passes first through the patient's body disposed on the patient support before being intercepted by the ion chamber 16 whereat the X-ray beam is transformed into visible light for generating a radiographic image on the X-ray development film 18 therebelow.

The X-ray imaging apparatus 1 includes an operator's control terminal 20 which is connected to an X-ray generator 21 using suitable cabling carrying various control signals in a manner well known in the art. The X-ray generator is connected to an X-ray tube 12 using high voltage cable.

In accordance with the present invention, the X-ray generator 21 includes a digital input circuit 22 connected to a digital output circuit 24 disposed at the ion chamber 16 via a digital communication interface cable 26. The interface cable preferably includes shielded wires adapted to communicate digital signals between the digital output circuit 24 and the digital input circuit 22. In addition, the digital communication interface cable 26 further preferably includes a set of field select logic signal conductors 28 best shown in FIG. 5.

Figure 2:
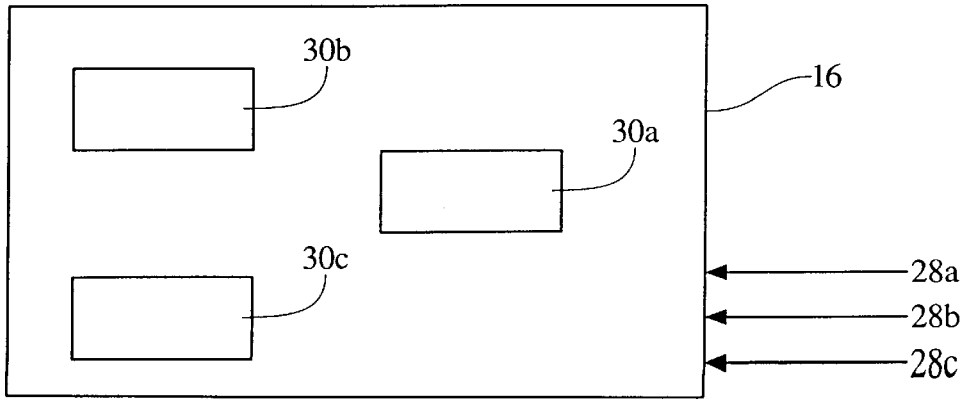
FIG. 2 is a diagrammatic illustration of the preferred ion chamber arrangement for the X-ray imaging apparatus of FIG. 1.

Turning next to FIG. 2, the ion chamber 16 of the present invention preferably includes a set of X-ray sensors 30*a–c*. The X-ray sensors are arranged on the ion chamber 16 substantially as shown in order to determine the level of X-ray beam passing through various locations of the patient's body during an imaging procedure. More particularly, as illustrated, a first X-ray sensor 30*a* is disposed substantially along a center line bisecting the ion chamber. The first X-ray sensor is thereby adapted to sense the level of the X-ray beam passing through the abdomen or head of a patient on the patient support. The second and third X-ray sensors 30*b*, 30*c* are offset slightly from the center line bisecting the ion chamber in a manner to substantially correspond to the right and left lungs of a patient disposed on the patient support. Although FIG. 2 illustrates three X-ray sensors arranged on the ion chamber as shown, other quantities of X-ray sensors may be used and in other configurations making the present invention useful for all types of X-ray imaging procedures.

With continued reference to FIG. 2, each of the X-ray sensors 30*a–c* are independently actuated by a one of the set of field select logic signal conductors 28*a*–28*c*. This is extremely useful because, using this field select line scheme, a single ion chamber device can be used for multiple X-ray imaging procedures. As an example, field select logic signals 28*b*, 28*c* would be activated during a first radiographic imaging procedure on a patient's lungs and the field select logic signal 28*a* would be activated during a second imaging procedure on the first patient's abdomen or head, or on the head or abdomen of a second patient. During the lung imaging, the field select logic signal 28*a* is inactive thus disabling the X-ray sensor 30*a*. Similarly, the field select logic signals 28*b* and 28*c* are inactive during the abdomen or head imaging procedure rendering the X-ray sensors 30*b* and 30*c* inactive.

Figure 3:
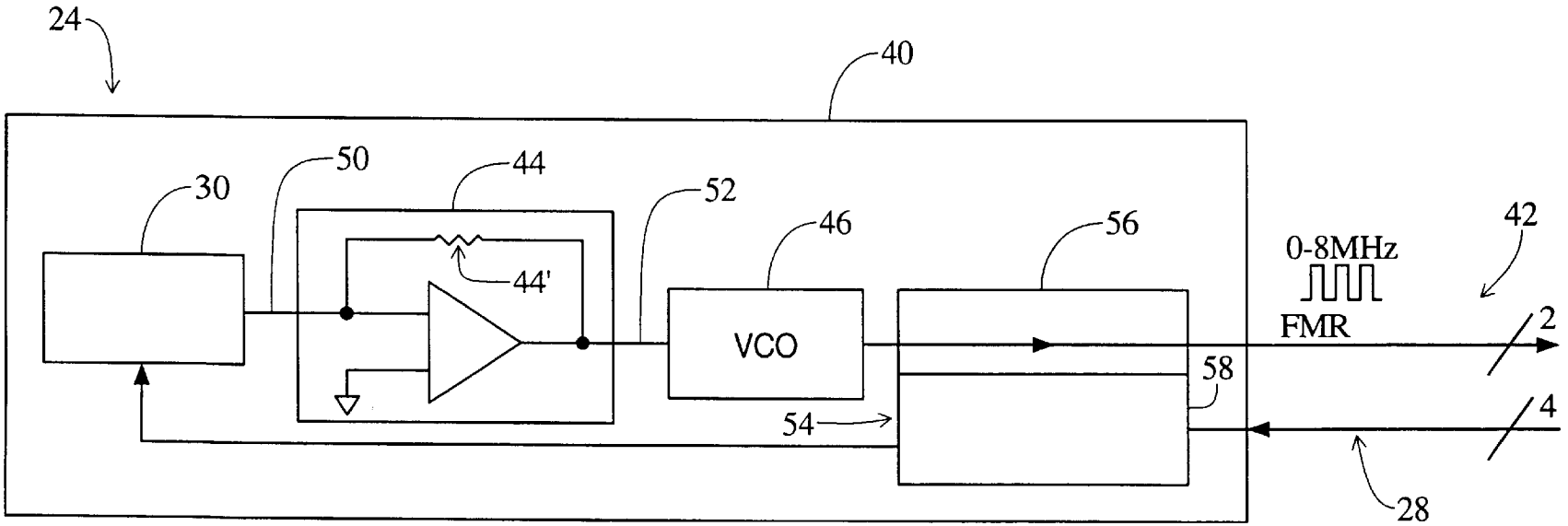
FIG. 3 is a detailed diagrammatic illustration of the digital output circuit portion of the digital automatic exposure control system of FIG. 1.

Turning next to FIG. 3, the digital output circuit 24 is preferably a digital frequency modulated output signal circuit 40 generating a digital frequency modulated output signal 42 having a pulse rate that is frequency modulated in proportion to the level of the X-ray beam 14 received at the ion chamber 16. In that regard, the digital output circuit 40 includes an X-ray beam sensor 30, a current-to-voltage converter circuit 44, and a voltage controlled oscillator circuit 46.

The X-ray beam sensor 30 receives the X-ray beam 14 and generates an electric current output signal 50 having a current level in proportion to the intensity of the X-ray beam received at the X-ray sensor 30.

The current-to-voltage converter circuit 44 is connected to the X-ray beam sensor in the manner substantially as shown. The current-to-voltage converter circuit converts the electric current output signal 50 to an electric voltage output signal 52 having a voltage level proportional to the current level in the current output signal 50.

Lastly, the voltage controlled oscillator circuit 46 is connected to the current-to-voltage converter circuit 44 in a manner as shown for receiving the electric voltage output signal 52 and generating the digital frequency modulated output signal 42 based on the voltage level of the electric voltage output signal 52.

In. the preferred embodiment illustrated, the current-to-voltage converter circuit 44 includes a gain resistor 44' for adjusting the gain between the electric circuit output signal 50 and the electric voltage output signal 52. Also, preferably, the X-ray sensor 30 is selected to generate an electric circuit output signal preferably between the range of 1–10 nano amperes (1–10 nA). The voltage controlled oscillator circuit 46 is a commercially available device having an output range from 0 MHz to 8 MHz. In that way, the digital frequency modulated output signal 42 generated by the digital output circuit 24 is within the range of 0 MHz to 8 MHz.

Lastly in connection with FIG. 3, the digital output circuit 24 includes an optocoupler interface circuit 54 including a signal output portion 56 and a logic signal input portion 58. The details of the optocoupler interface circuit 54 will be described in greater detail below in connection with FIG. 5.

Figure 4:
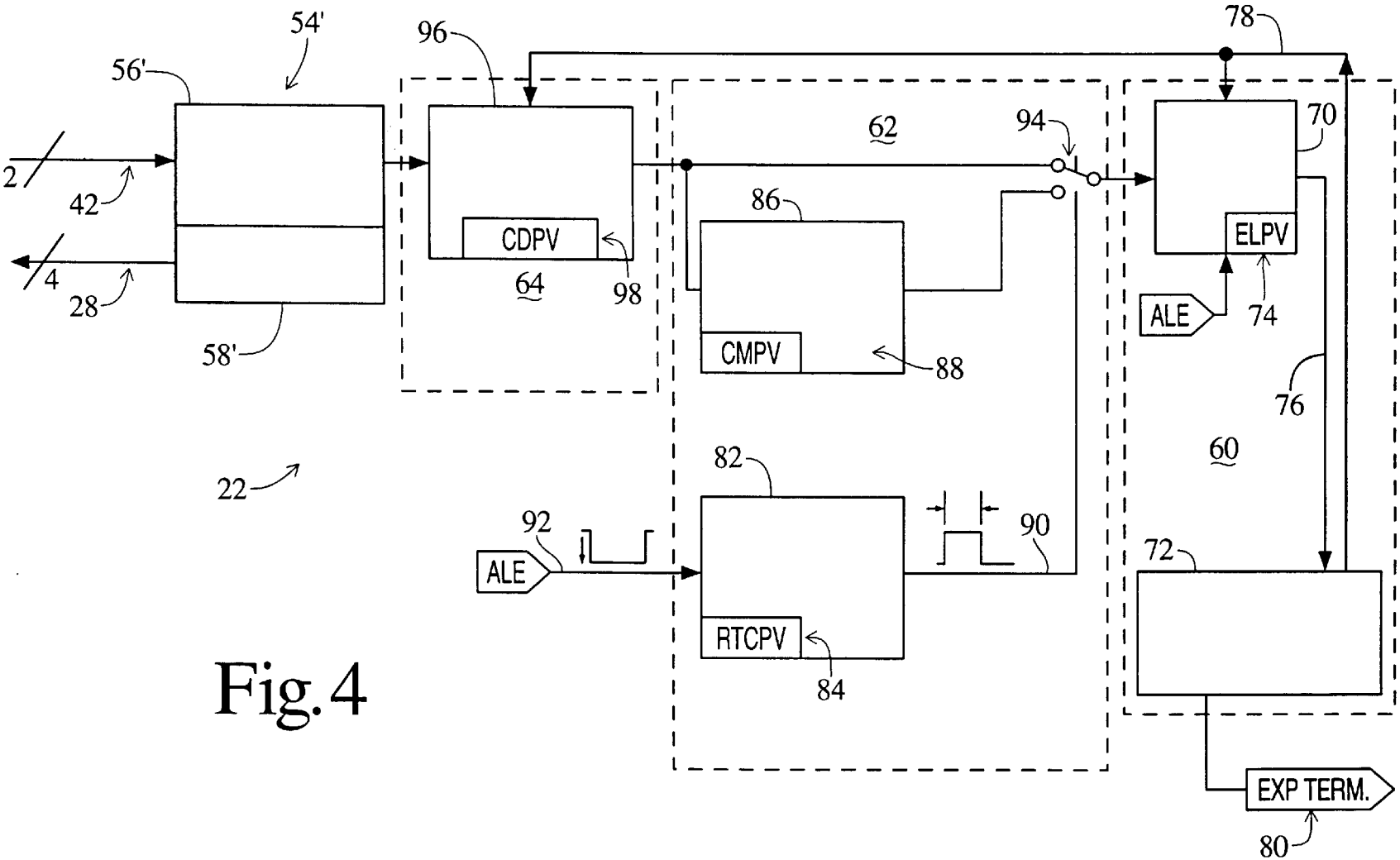
FIG. 4 is a detailed diagrammatic illustration of the digital input circuit of the digital automatic exposure control system of FIG. 1; and, FIG. 5 is a diagrammatic illustration of the cabling interface between the digital output circuit of FIG. 3 and the digital input circuit of FIG. 4.

Turning next to FIG. 4, the digital input circuit 22 includes a pulse counting circuit 60, a digital short-time compensation circuit 62, an X-ray film screen sensitivity compensation circuit 64, and an optocoupler interface circuit 54'. The optocoupler interface circuit includes an exposure level signal input portion 56' and a field enable logic signal output portion 58'. The optocoupler signal input and output portions 56', 58' of the interface circuit 54' cooperate with the optocoupler signal output and input portions 56, 58 of the interface circuit 54, respectively, in a manner described subsequently in connection with FIG. 5.

With continued reference to FIG. 4, however, the pulse counting circuit 60 includes a digital counter circuit 70 and a processor circuit 72 connected in a manner substantially as shown. The digital counter circuit 70 is preferably a 24 bit counter circuit although, however, larger counters could be used as necessary. The digital counter circuit counts pulses in the digital frequency modulated output signal 42 as a pulse count. In addition, the digital counter circuit 70 is adapted to load an exposure length parameter value 74 into a counter register in response to a counter register load signal 78 generated prior to X-ray exposure. The digital counter circuit counts pulses in the digital output signal as a pulse count value and generates a count match signal 76 when the pulse count value corresponds to the exposure length parameter value 74 loaded in the counter register.

The digital processor circuit 72 generates an exposure termination signal 80 in response to receiving the count match signal 76 from the digital counter circuit 70. The exposure termination signal 80 is used by the generator 21 of the X-ray imaging apparatus 1 to interrupt the generation of the X-ray beam 14.

The digital short-time exposure compensation circuit 62 is adapted to modify the digital output signal 42 generated by the digital signal output circuit 24 to compensate the digital automatic exposure control system of the present invention for variations in ion chamber response delay time and X-ray generator exposure termination delay time. Preferably, the digital short-time compensation circuit 62 includes a programmable pulse generator circuit 82 adapted to store a response time calibration parameter value 84 and a programmable frequency multiplier circuit 86 adapted to store a clock multiplier parameter value 88. The programmable pulse generator circuit 82 generates a timing pulse 90 having a selectable duration in response to receiving an actual length of exposure signal 92 from the X-ray imaging apparatus 1. The timing pulse 90 is sustained for a predetermined period based on the response time calibration parameter value 84 stored in the digital short-time compensation circuit 62.

The digital programmable frequency multiplier circuit 86 selectively scales the digital output signal 42 by multiplying the digital output signal during the first time period by the clock multiplier parameter value 88. The clock multiplier parameter value 88 is between the range of 1 and 3 but, preferably, is set to two (2). A logical switch 94 is illustrated to represent that the digital output signal is scaled only during the first period determined by the programmable pulse generator 82. Preferably, the first time period is about 1 millisecond but is adjustable, as described above, based on the response time calibration parameter value 84 stored in the digital short-time compensation circuit 62.

The digital input circuit 22 also includes an X-ray film screen sensitivity compensation circuit 64 for modifying the digital output signal 42 generated by the digital signal output circuit 24 to compensate the automatic exposure control system of the present invention for variations in the film speed of the X-ray film screen used by the X-ray imaging apparatus 1 at the ion chamber. Preferably, the X-ray film screen sensitivity compensation circuit 64 includes a programmable clock divider circuit 96 adapted to load a programmable clock divider parameter value 98 into a clock divider register prior to X-ray exposure for scaling the digital frequency modulated output signal 42 as it is passed through the programmable clock divider circuit. In the preferred embodiment, the programmable clock divider circuit 96 is an eight (8) bit programmable clock divider, although other size divider circuits could be used as necessary.

Figure 5:
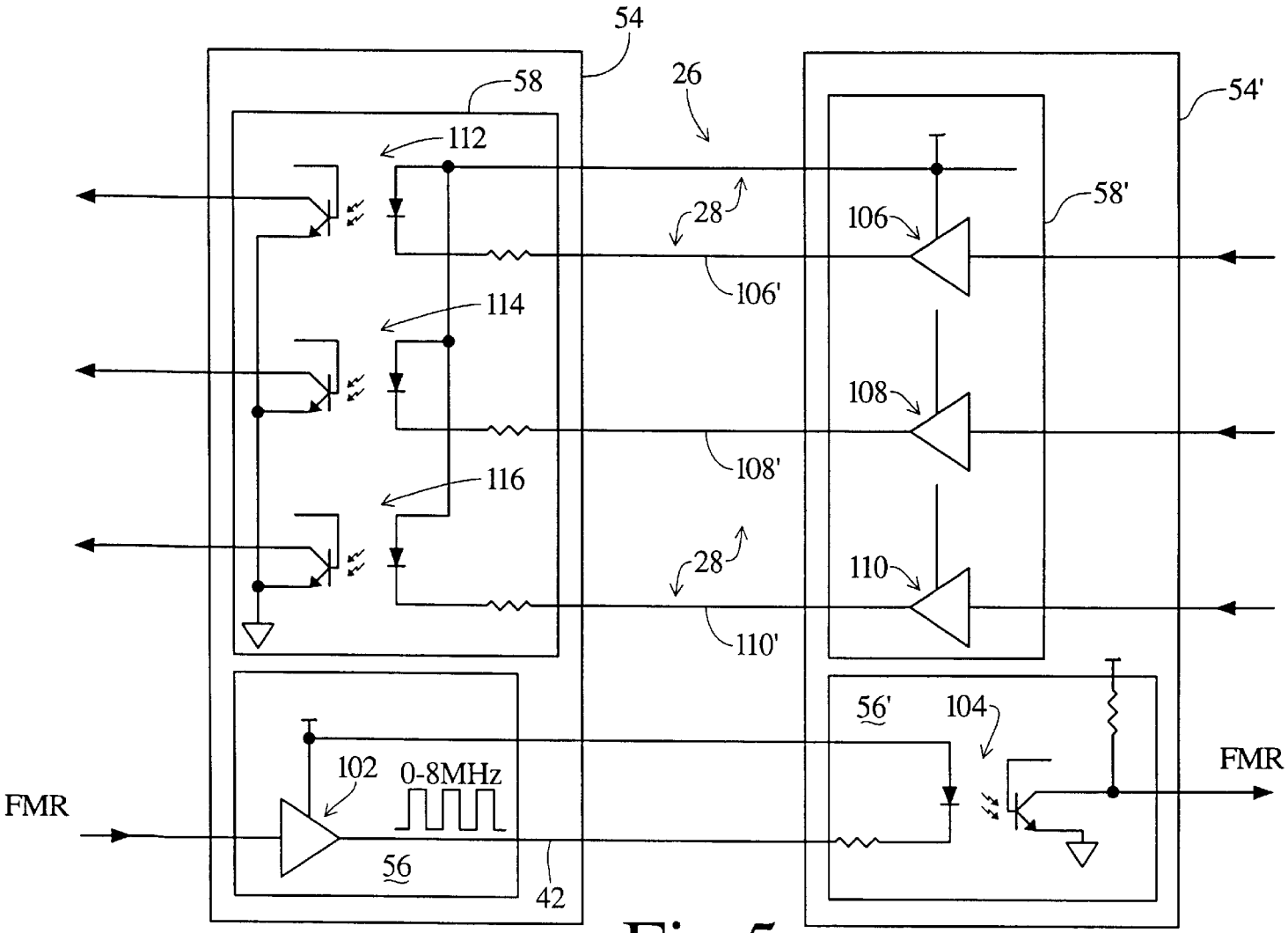

Turning lastly to FIG. 5, the exposure level signal output portion 56 of the optocoupler interface circuit 54 includes signal buffer 102 for amplifying the digital frequency modulated output signal 42 to interface the digital output circuit 24 to the digital communication interface cable 26. The exposure level signal input portion 56' of the optocoupler interface circuit 54' at the digital input circuit 22 includes an electronic optocoupler pair 104 for electrically isolating the exposure level signal output circuit 56 from the exposure level signal input circuit 56'.

Similar to the above, the field enable logic signal output portion 58' of the optocoupler interface circuit 54' includes a set of amplifier circuits 106, 108, 110 for amplifying a corresponding set of field enable logic signals 106', 108', 110' to better interface the digital input circuit 22 with the digital communication interface cable 26.

A set of electronic optocoupler circuits 112, 114, 116 are provided in the field enable logic signal input portion 58 of the optocoupler interface circuit 54 to provide electrical isolation between the digital input circuit 22 and the digital output circuit 24.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the preferred embodiment, the invention is now claimed to be:

1. A digital automatic exposure control system for use with an operatively associated imaging apparatus of the type generating an X-ray beam from an X-ray generator and receiving the X-ray beam on an X-ray film screen at an ion chamber, the digital automatic exposure control system comprising:

a digital signal output circuit at the ion chamber of the imaging apparatus, the digital signal output circuit being adapted to generate a digital frequency modulated output signal having a pulse rate that is frequency modulated in proportion to the level of the X-ray beam received at the ion chamber; and, a digital signal input circuit operatively connected to the X-ray generator of the imaging apparatus, the digital signal input circuit being adapted to count pulses in the digital frequency modulated output signal as a pulse count and generate an exposure termination signal for use by the imaging apparatus to interrupt generation of the X-ray beam when the pulse count matches a predetermined level.

2. The digital automatic exposure control system according to claim 1 wherein said digital signal input circuit includes:

a digital counter circuit adapted to count pulses in said digital frequency modulated output signal as a pulse count value and generate a count match signal based on comparison between said pulse count value and an exposure length parameter value stored in the digital signal input circuit; and, a processor circuit adapted to generate said exposure termination signal in response to receiving said count match signal from the digital counter circuit.

3. The digital automatic exposure control system according to claim 1 wherein said digital signal output circuit includes:

an X-ray beam sensor adapted to receive said X-ray beam and generate an electric current output signal having a current level in proportion to said intensity level of said X-ray;

a current to voltage converter circuit operatively connected to said X-ray beam sensor, the current to voltage converter circuit being adapted to convert said electric current output signal to an electric voltage output signal having a voltage level proportional to said current level; and, a voltage controlled oscillator circuit operatively connected to said current to voltage converter circuit, the voltage controlled oscillator circuit being adapted to receive said electric voltage output signal and generate said digital frequency modulated output signal based on said voltage level of said electric voltage output signal.

4. The digital automatic exposure control system according to claim 3 wherein:

the digital signal output circuit is coupled to the digital signal input circuit by an electronic optocoupler; and, the digital signal output circuit is adapted to generate said digital frequency modulated output signal within a frequency range of 0 MHZ to 8 MHZ.

5. The digital automatic exposure control system according to claim 4 wherein:

said digital signal output circuit is adapted to generate said digital frequency modulated output signal in proportional to an instantaneous intensity level of said X-ray beam received at the ion chamber;

said X-ray beam sensor is adapted to generate said electric current output signal having said current level in proportion to said instantaneous intensity level of said X-ray; and, said voltage controlled oscillator circuit is adapted to generate said digital frequency modulated output signal within said frequency range of 0 MHZ to 8 MHZ based on said level of said electric voltage output signal.

6. The digital automatic exposure control system according to claim 1 wherein:

the digital signal output circuit includes:

a plurality of X-ray beam sensors adapted to receive said X-ray beam at spaced apart locations at the ion chamber of the operatively associated imaging apparatus and selectively generate an electric current output signal having a current level proportional to said intensity level of said X-ray beam, each of said plurality of X-ray beam sensors being operative in response to a corresponding plurality of sensor enable signals received from said digital signal input circuit;

a current to voltage converter circuit operatively connected to said plurality of X-ray beam sensors, the current to voltage converter circuit being adapted to convert said electric current output signals from an enabled one of said plurality of X-ray beam sensors to an electric voltage output signal having a voltage level proportional to said current level; and, a voltage controlled oscillator circuit operatively connected to said current to voltage converter circuit, the voltage controlled oscillator circuit being adapted to receive said electric voltage output signal and generate said digital frequency modulated output signal based on said voltage level of said electric voltage output signal; and, the digital signal input circuit includes:

a plurality of field select circuits responsive to the X-ray generator of the associated imaging apparatus for generating said plurality of sensor enable signals.

7. The digital automatic exposure control system according to claim 3 wherein said digital signal input circuit includes:

an X-ray film screen sensitivity compensation circuit adapted to modify the digital frequency modulated output signal generated by the voltage controlled oscillator circuit to compensate the digital automatic exposure control system for variations in film speed of said X-ray film screen used by the operatively associated imaging apparatus at the ion chamber;

a digital short time compensation circuit adapted to modify the digital frequency modulated output signal generated by the voltage controlled oscillator circuit to compensate the digital automatic exposure control system for variations in ion chamber response delay time and X-ray generator exposure termination delay time;

a digital counter circuit adapted to count pulses in said digital frequency modulated output signal as a pulse count value and generate a count match signal based on a comparison between said pulse count value and an exposure length parameter value stored in the digital signal input circuit; and, a processor circuit adapted to generate said exposure termination signal in response to receiving said count match signal from the digital counter circuit.

8. The digital automatic exposure control system according to claim 7 wherein:

the X-ray film screen sensitivity compensation circuit is a programmable clock divider circuit adapted to scale said digital frequency modulated output signal generated by said voltage controlled oscillator circuit by dividing the digital output signal by a clock divider parameter value; and, the digital short time compensation circuit includes:

a programmable pulse generator circuit adapted to generate a timing pulse having a selectable duration in response to an actual length of exposure signal generated by the operatively associated imaging apparatus, the timing pulse being sustained for a first period based on a response time calibration parameter value stored in the digital short time compensation circuit; and, a programmable frequency multiplier circuit adapted to selectively scale said digital frequency modulated output signal generated by said digital signal output circuit by multiplying the digital output signal during said first period by a clock multiplier parameter value stored in the digital short time compensation circuit.

9. The digital automatic exposure control system according to claim 1 further comprising:

an X-ray film screen sensitivity compensation circuit adapted to modify the digital frequency modulated output signal generated by the digital signal output circuit to compensate the digital automatic exposure control system for variations in film speed of said X-ray film screen used by the operatively associated imaging apparatus at the ion chamber.

10. The digital automatic exposure control system according to claim 9 wherein the X-ray film screen sensitivity compensation circuit is a programmable clock divider circuit adapted to scale said digital frequency modulated output signal generated by said digital signal output circuit by dividing the digital frequency modulated output signal by a clock divider parameter value.

11. The digital automatic exposure control system according to claim 1 further comprising:

a digital short time compensation circuit adapted to modify the digital frequency modulated output signal generated by the digital signal output circuit to compensate the digital automatic exposure control system for variations in ion chamber response delay time of the associated imaging apparatus and X-ray generator exposure termination delay time of the associated imaging apparatus.

12. The digital automatic exposure control system according to claim 11 wherein the digital short time compensation circuit includes:

a programmable pulse generator circuit adapted to generate a timing pulse having a selectable duration in response to an actual length of exposure signal generated by the operatively associated imaging apparatus, the timing pulse being sustained for a first period based on a response time calibration parameter value stored in the digital short time compensation circuit; and, a programmable frequency multiplier circuit adapted to selectively scale said digital frequency modulated output signal generated by said digital signal output circuit by multiplying the digital frequency modulated output signal during said first period by a clock multiplier parameter value stored in the digital short time compensation circuit.

13. In an imaging apparatus of the type generating an X-ray beam from an X-ray generator and receiving the X-ray beam on an X-ray film screen at an ion chamber, an automatic X-ray exposure control system comprising:

an output circuit at the ion chamber of the imaging apparatus for generating a digital X-ray exposure signal having a pulse rate that is frequency modulated in proportion to the instantaneous level of the X-ray beam received at the ion chamber; and, an input circuit at the X-ray generator receiving the digital X-ray exposure signal from the signal output circuit for counting pulses in the digital X-ray exposure signal as a pulse count and generating an exposure termination signal when the pulse count reaches a predetermined count for use by the imaging apparatus to interrupt generation of the X-ray beam.

14. The imaging apparatus according to claim 13, wherein the output signal circuit includes i) an X-ray beam sensor adapted to receive said X-ray beam and generate an electric current output signal having a current level in proportion to said intensity level of said X-ray; ii) a current to voltage converter circuit operatively connected to said X-ray beam sensor, the current to voltage converter circuit being adapted to convert said electric current output signal to an electric voltage output signal having a voltage level proportional to said current level; and, iii) a voltage controlled oscillator circuit operatively connected to said current to voltage converter circuit, the voltage controlled oscillator circuit being adapted to receive said electric voltage output signal and generate said digital frequency modulated X-ray exposure signal based on said voltage level of said electric voltage output signal.

15. The imaging apparatus according to claim 14 wherein the input circuit includes i) a digital counter circuit adapted to count pulses in said digital frequency modulated X-ray exposure signal as said pulse count and generate a count match signal based on comparison between said pulse count and an exposure length parameter value stored in the input circuit; and, ii) a processor circuit adapted to generate, in response to receiving said count match signal from the digital counter circuit, said exposure termination signal for use by the X-ray generator of the imaging apparatus to interrupt said generation of the X-ray beam.

16. The imaging apparatus according to claim 15, further comprising:

an X-ray film screen sensitivity compensation circuit adapted to modify the digital frequency modulated X-ray exposure signal generated by the output circuit to compensate the automatic exposure control system for variations in film speed of said X-ray film screen used by the operatively associated imaging apparatus at the ion chamber, the X-ray film screen sensitivity compensation circuit including a programmable clock divider circuit adapted to scale said digital frequency modulated X-ray exposure signal generated by said output circuit by dividing the digital output signal by a clock divider parameter value.

17. A digital output circuit in an X-ray imaging apparatus of the type including an X-ray generator generating an X-ray beam and an ion chamber receiving the x-ray beam, the digital output circuit comprising:

a digital frequency modulated output circuit at said ion chamber of the imaging apparatus, the digital frequency modulated output circuit generating a digital frequency modulated output signal having a pulse rate that is frequency modulated in proportion to the instantaneous intensity of the X-ray beam received at the ion chamber.

18. The digital output circuit according to claim 17 wherein said digital frequency modulated output circuit includes:

an X-ray beam sensor adapted to receive said X-ray beam and generate an electric current output signal having a current level in proportion to said intensity level of said X-ray;

a current to voltage converter circuit operatively connected to said X-ray beam sensor, the current to voltage converter circuit being adapted to convert said electric current output signal to an electric voltage output signal having a voltage level proportional to said current level; and, a voltage controlled oscillator circuit operatively connected to said current to voltage converter circuit, the voltage controlled oscillator circuit being adapted to receive said electric voltage output signal and generate said digital frequency modulated output signal based on said voltage level of said electric voltage output signal.

19. The digital output circuit according to claim 17 wherein the digital frequency modulated output circuit is adapted to generate said digital frequency modulated output signal within a frequency range of 0 MHZ to 8 MHZ.

20. The digital output circuit according to claim 17 wherein the output circuit is adapted to generate said digital frequency modulated output signal having said pulse rate that is frequency modulated in proportion to the instantaneous intensity of the x-ray beam received at the ion chamber.

21. A digital automatic exposure control system for use with an associated X-ray imaging apparatus of the type including an X-ray generator generating an X-ray beam and an ion chamber receiving the X-ray beam, the digital automatic exposure control system comprising:

a digital frequency modulated radiation signal output circuit at said ion chamber of the imaging apparatus, the digital frequency modulated radiation signal output circuit being adapted to generate a digital frequency modulated radiation output signal that is frequency modulated in proportion to the instantaneous intensity of the X-ray beam received at the ion chamber; and, a digital frequency modulated radiation signal input circuit at said X-ray generator of the imaging apparatus, the digital frequency modulated radiation signal input circuit being adapted to count pulses in the digital frequency modulated radiation output signal and generate an exposure termination signal for use by the associated imaging apparatus to interrupt generation of the X-ray beam in response to receiving said exposure termination signal.

* * * * *